United States Patent [19]

Patel

[11] Patent Number: 4,650,650

[45] Date of Patent: Mar. 17, 1987

[54] COPPER-BASED ALLOY WITH IMPROVED CONDUCTIVITY AND SOFTENING PROPERTIES

[75] Inventor: Vinayak K. Patel, Buffalo Grove, Ill.

[73] Assignee: American Brass Company, L.P., Buffalo, N.Y.

[21] Appl. No.: 543,717

[22] Filed: Oct. 20, 1983

[51] Int. Cl.[4] ..... C22C 9/02

[52] U.S. Cl. ..... 420/472; 148/433; 420/500

[58] Field of Search ..... 420/469–475, 420/500, 493; 148/11.5 C, 432, 433, 412; 428/674

[56] References Cited

U.S. PATENT DOCUMENTS

| | | | |
|---|---|---|---|
| 3,773,503 | 11/1973 | Krantz et al. | 420/499 |
| 4,311,522 | 1/1982 | Batra et al. | 148/11.5 C |
| 4,492,602 | 1/1985 | Lee et al. | 420/500 |

FOREIGN PATENT DOCUMENTS

| | | | |
|---|---|---|---|
| 4179 | 2/1975 | Japan | 420/470 |
| 99029 | 8/1978 | Japan | 420/472 |
| 39146 | 3/1982 | Japan | 420/474 |
| 94539 | 6/1982 | Japan | 420/472 |
| 140878 | 8/1982 | Japan | 420/469 |

OTHER PUBLICATIONS

Smart et al., "The Effect of Certain Elements on the Properties of High-Purity Copper", The Metal Industry, Sep. 10, 1943, pp. 170–172.

Mendenhall, *Understanding Copper Alloys,* Olin Brass, East Alton, Illinois, 1977, p. 66.

Reed et al., "Low Temperature Mechanical Properties of Copper and Selected Copper Alloys", Inst. for Matls. Research, NBS, Monograph 101, issued Dec. 1, 1967, p. 38.

Copper Development Association, Symposium on Effect of Research and Design on the Use of Copper in the Electrical Industry, 10/10/62, pp. 15+22.

*Primary Examiner*—Peter K. Skiff

*Attorney, Agent, or Firm*—James W. McClain; Stanley A. Becker

[57] ABSTRACT

A copper-based alloy is described consisting essentially of:

| | |
|---|---|
| Tin | 25–225 ppm |
| Tellurium or Selenium | 25–225 ppm |
| Phosphorus | 10–50 ppm |
| Copper | Balance |

The alloys can be used in many forms, including sheet, strip, bar, rod and wire. Sheet stock made from this alloy is useful as automotive radiator fin stock. In addition, electrical components can be made from the alloy of this invention. All of these materials have thermal and electrical conductivity properties and softening temperatures equal to or better than the prior art alloys adapted for these applications. In addition, the alloys of this invention can utilize relatively inexpensive materials and do not present significant toxicity problems and are readily analzyed using common industrial analysis equipment.

7 Claims, No Drawings

COPPER-BASED ALLOY WITH IMPROVED CONDUCTIVITY AND SOFTENING PROPERTIES

TECHNICAL FIELD

The invention herein relates to copper-based alloys containing small amounts of alloying elements. More particularly it relates to such alloys which find use as radiator fin stock and for electrical applications.

BACKGROUND ART

Copper-based alloys are widely used to make automobile radiator fin stock. The fabrication of radiators involving the use of molten solder baths and high temperature solders, and the service environment for radiators with modern high temperature automobile engines, both dictate that radiator alloys have good thermal conductivity and high softening temperatures.

Electrical applications for copper-based alloys also require that the alloys have high softening temperatures, to resist the high temperatures often generated in high voltage electrical switching applications. Of course for such electrical applications the alloys must also have good electrical conductivity.

A wide variety of different copper-based alloys have been proposed in the past for use in such automotive and electrical applications and the effects of various alloying elements on the alloys for such services have been carefully studied. Studies on softening temperatures, for instance, have been described in U.S. Pat. No. 3,649,254 to I. S. Servi, with particular emphasis in this patent on copper-tin-oxygen alloys. Frequently such alloys required the use of very costly alloying elements and/or elements with high toxicity. Servi, for instance, describes the use of silver as an alloying element to raise softening temperature. Another alloy in commercial use uses cadmium as the principal alloying element.

Alloys have been described which attempt to avoid the use of expensive and/or toxic alloying elements and still obtain properties of the type required for automotive and/or electrical applications, U.S. Pat. No. 3,773,503 to P. J. Kranz, et al, describes an alloy for automotive use in which the principal alloying elements are 20–150 ppm phosphorus and 200–400 ppm tellurium alloyed in copper. Similarly, U.S. Pat. No. 3,700,842 to E. A. Attia describes an electrical service alloy in which the principal alloying elements are 4,000–6,000 ppm tellurium and 70–120 ppm phosphorus in oxygen free high conductivity copper. These alloys, while providing the needed properties and avoiding the use of unduly or expensive toxic materials, often have the disadvantage that they require the use of high purity (and therefore expensive) copper. In addition, they utilize large amounts of the alloying elements (especially tellurium), also adding to the cost of the alloy.

U.S. Pat. No. 4,311,522 to R. Batra, et al, describes a copper-based alloy containing selenium and manganese as a replacement for copper-silver alloys. These alloys are described as significantly better in their properties than copper-tellurium, copper-sulfur-tellurium or copper-manganese-tellurium alloys.

In another context, the International Copper Research Association (INCRA) has sponsored a study of ternary copper alloy properties. Among the alloys studied was a copper/22 ppm selenium/60 ppm tin alloy. The study is reported in the "Contractor Report" for INCRA Project No. 344, "Solute Effects In Very Dilute Ternary Copper Alloys", by M. Ohring of Stevens Institute of Technology (January, 1983). There is also a paper by Pitt, et al, *Met. Trans.*, 10*A*, 809 (1979) briefly describing property studies of copper/selenium/tin alloys with less than 100 ppm total selenium and tin content.

It would be advantageous to have a lower cost copper-based alloys which employ as alloying elements materials which are neither unduly expensive nor toxic and which need not be used in large concentrations. Such alloys would of course need to have the required properties for either automotive or electrical use. The alloys of this invention meet such requirements.

Disclosure of Invention

The invention herein is a copper-based alloy having good electrical conductivity properties as well as improved resistance to recovery, recrystallization and grain growth, which imparts high softening temperature to the alloy. The alloy also has low concentrations of alloying elements, as will be seen from its broadest embodiment, in which the alloy consists essentially of:

| | |
|---|---|
| Tin | 25–225 ppm |
| Tellurium or Selenium | 25–225 ppm |
| Phosphorus | 10–50 ppm |
| Copper | Balance |

The total concentration of the tin, tellurium and phosphorus alloying elements will be not greater than about 500 ppm.

Preferably the alloy composition will consist essentially of:

| | |
|---|---|
| Tin | 40–175 ppm |
| Tellurium or Selenium | 40–175 ppm |
| Phosphorus | 20–50 ppm |
| Copper | Balance |

Also preferably the total quantity of the non-copper alloying elements will be at least 100 ppm.

Modes For Carrying Out The Invention

As is well known, the properties of copper-based alloys can be varied considerably by the presence of significant amounts of elements other than the desired alloying elements. When, as here, the desired alloying elements are present in relatively low concentration, the possible adverse effects of the presence of small amounts of other elements can be pronounced. Consequently those skilled in the art will recognize the necessity of using raw materials and alloying techniques which minimize the incorporation of such unwanted elements into the finished alloy.

The mechanism providing the novel properties of these alloys is not fully defined, and so is not to be considered to be limiting in any way herein. It is believed, however, that the elements in the metal alloy chemically interact with a synergistic effect, producing properties which are not simply additive functions of the elements individually. This results in high conductivity enen with low elemental content.

The content levels of the elements in the present alloys are sometimes referred to in other alloy contexts as "impurity levels," and in those contexts the effects of the "impurities" can be disregarded. In the present alloys, however, the elements, even though present at low levels, are decidedly functional. In addition, those of the specific critical elements herein (tin, selenium and tellurium) are not normally found as trace element impurities in copper.

The alloy compositions herein may be made by any convenient method and from any appropriate materials. While raw materials of adequate purity are desirable, it is possible to include inert elements in the composition without effecting the alloy properties. For instance, zinc in an amount up to 2 percent by weight can be present with no significant effect on the alloy properties. The following example, while not limiting, describes formation of a typical composition and the materials from which it is formed. The tellurium is incoporated in the form of cuprous telluride ($Cu_2Te$) as 99.9% pure, the tin as 99.9% purity tin and the phosphorus in the form of a high purity 15% copper-phosphorus master alloy which has previously been prepared under similar high purity standards. The copper matrix for the alloy is itself advantageously provided as cathode copper.

Alternatively, other forms of the raw materials may be used. Master alloys may have varying degrees of purity depending on the final use intended for the alloy. In addition, small traces of any other elements which may be incorporated during alloying element addition will be thoroughly diluted in the final alloy. Deleterious elements or elements in deleterious concentrations are of course to be avoided. Actual raw materials, such as cathode copper, can often be selected on the basis of cost.

The concentration of each of the alloying elements are as given above. The maximum concentrations set forth are not absolute, for more of each element may be present to a reasonable degree without adverse effect. However, no further improvement in properties is obtained beyond these maxima so the excess quantities are of no benefit and add unnecessary cost to the alloy.

The concentrations of the alloying elements are such that, even at the minimum levels, the compositions can be readily analyzed with normal industrial analysis equipment. This is advantageous for the alloy manufacturer or user, for alloy composition control can be maintained and monitored easily in the industrial environment, without the need for sophisticated laboratory equipment and techniques.

All of these raw materials (or similar raw materials providing the tin, tellurium or selenium, phosphorus and copper) are melted in standard metallurgical crucibles which serves to minimize the incorporation of trace elements, such as crucibles formed from ATP graphite, or in refractory lined production melting furnaces. Conventional alloy melting and casting techniques are used.

The alloys of this invention can be used in many different metal forms including, but not limited to, sheet, strip, rod, bar and wire. The exact geometry into which the alloy is formed is not critical. It is also intended that the invention shall not be limited by any differences found among trade and general definitions of terms such as "strip" or "sheet". Thus the procedure below is intended to be examplary only, and not limiting as to any final metal geometry.

Once cast, the cast cakes, billets or rods are put through a number of rolling or drawing steps to provide the desired strip or wire stock. In a typical procedure, the starting materials from a 900° C. (1650° F.) furnace are first hot rolled to reduce their thickness to approximately ½" (12 mm) on a hot mill and then machined to remove approximately 0.05" (0.13 mm) from the thickness, thus eliminating the oxide scale which has been formed. The machined materials are then cold rolled to impart approximately 37% reduction and reduce the thickness to 0.275" (7 mm). Thereafter the reduced stock is solution annealed at 600° C. (1110° F.) or more for an hour and quenched to allow formation of a desired grain size of approximately 0.030–0.060 mm. Following the quench, the material is cold rolled to reduce the thickness to 0.080" (2 mm). At this point there are two alternative methods to obtain a final desired strip thickness, which for exemplary purposes will be here defined to be 0.010" (0.25 mm). In the first alternative, the cold rolled sheet is directly taken to a strand annealer for annealing at 815° C. (1500° F.) to produce the desired grain size of 0.020–0.030 mm. Following annealing the strip is cold rolled for 87.5% reduction to reach the desired 10 mil thickness. Alternatively one can take the 80 mil cold rolled strip and first reduce it in thickness by 75% to 0.018" (0.46 mm) by cold rolling followed by the 815° C. strand annealing and a final cold rolling of 44% reduction to the 0.010" final thickness.

The first hot working typically results in 40–70% reduction and is conducted at 750°–950° C. (1380°–1740° F). The subsequent first cold working results in 30–60% further reduction. The second cold working (after solution annealing) will produce 50–95% reduction, while the third cold working (after strip annealing) will produce 20–90% reduction. Cold working to 37% reduction will produce a "hard" alloy while 50% reduction will produce an "extra hard" alloy.

The alloys may be used in many different forms, as needed by the user, including sheet, strip, rod, bar and wire.

Typical examples of the alloys of this invention are illustrated in the Table below. The softening temperatures and conductivities of copper-tin-tellurium-phosphorus alloys using commercial cathode copper can be predicted from models to be on the order of about 400° C. and 90% IACS, respectively. Softening temperature determination is on the basis of one hour exposure at temperature. For comparison purposes, the softening temperature of the alloys exemplified herein were each determined by exposing samples of each alloy at temperatures of 200° C., 250° C., 300° C., 350° C., 400° C. and 600° C. for an hour, allowing the samples to cool to ambient temperature, and then determining their ultimate tensile strength. The ultimate tensile strength values were then plotted against the exposure temperature. "One hour softening temperature" is defined as the temperature at which the material has softened to an ultimate tensile strength value halfway between its unexposed ultimate tensile strength value and its ultimate tensile strength value when fully softened by exposure to 600° C. for one hour.

Electrical conductivity measurements were made using a Kelvin double bridge.

It will be understood that these conditions are only exemplary, and that actual processing conditions can be varied to meet the needs of the product end use. Such variations in conditions will be evident to those skilled in the alloy art.

TABLE

| Alloy No. | Sn | Te | P | Other | One Hour Softening Temperature, °C. 44% CW[b] | Electrical Conductivity at 20° C. % IACS 44% CW[b] |
|---|---|---|---|---|---|---|
| Control[c] | — | — | 50 | — | 375 | 90.6 |
| A | 70 | — | 50 | — | 340 | 92.6 |
| B | — | — | — | [d] | 215 | 98.4 |
| C | — | — | — | [e] | 230 | 97.1 |
| 1 | 40 | 40 | 50 | — | 340 | 96.1 |
| 2 | 60 | 60 | 50 | — | 360 | 95.9 |
| 3 | 130 | 110 | 50 | — | 365 | 95.1 |
| 4 | 50 | 50 | 50 | — | 345 | 95.4 |
| 5 | 60 | 70 | 50 | — | 360 | 95.5 |
| 6 | 70 | 40 | 50 | — | 350 | 95.6 |
| 7 | 70 | 70 | 50 | — | 345 | 95.4 |

NOTES:
[a]balance is copper
[b]CW = cold worked reduction
[c]the control was Copper Development Association alloy "C 143" containing 970 ppm cadmium and 50 ppm phosphorus in copper
[d]40 ppm manganese; 40 ppm selenium
[e]100 ppm manganese; 90 ppm selenium The data of the Table clearly shows that the properties of the alloys of this invention approach or exceed the predicted values. Also, they are equal to or better than the copper/cadmium or copper/manganese/-selenium alloys of the prior art.

Industrial Applicability

The invention herein is a copper-based alloy which finds significant utility in both the automotive and electrical industries. The alloy is useful in the industrial manufacture of automobile radiators and also finds utility as a material from which components in high voltage electrical switching equipment can be manufactured.

It will be evident to those skilled in the art that there are a number of embodiments which, while not specifically described above, are clearly within the scope and spirit of the invention. Consequently the above description is to be considered exemplary and the full scope of the invention is to be determined solely by the appended claims.

What is claimed is:

1. A copper-based alloy consisting essentially of:

| | |
|---|---|
| Tin | 25–175 ppm |
| Tellurium or Selenium | 25–175 ppm |
| Phosphorus | 10–50 ppm |
| Copper | Balance |

said alloy after 44% cold worked reduction having a one hour softening temperature within the range of from about 340° C. to about 365° C. and an electrical conductivity in the range of from about 95% IACS to about 96% IACS.

2. The alloy as in claim 1 consisting essentially of:

| | |
|---|---|
| Tin | 40–175 ppm |
| Tellurium or Selenium | 40–175 ppm |
| Phosphorus | 20–50 ppm |
| Copper | Balance |

3. The alloy as in claims 1 or 2 wherein the total content of said tin, tellurium, selenium and phosphorus is not less than 100 ppm.

4. The alloy as in claims 1 or 2 containing selenium.

5. The alloy as in claims 1 or 2 containing tellurium.

6. A metal alloy consisting essentially of the alloy of claims 1 or 2, in the form of sheet, strip, rod, bar or wire.

7. An automotive radiator comprising sheet or strip metal consisting essentially of the alloy of claims 1 or 2.

* * * * *